US009579778B2

(12) United States Patent
Hsieh

(10) Patent No.: US 9,579,778 B2
(45) **Date of Patent: *Feb. 28, 2017**

(54) ELECTRONIC TORQUE WRENCH WITH IMPROVED HANDLE

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 464 days.

This patent is subject to a terminal disclaimer.

(21) Appl. No.: 14/109,352

(22) Filed: Dec. 17, 2013

(65) Prior Publication Data

US 2014/0165798 A1 Jun. 19, 2014

(30) Foreign Application Priority Data

Dec. 19, 2012 (TW) ..... 101148379 A

(51) Int. Cl.

| | |
|---|---|
| ***B25B 23/142*** | (2006.01) |
| ***B25B 13/46*** | (2006.01) |
| ***B25G 1/04*** | (2006.01) |
| ***B25G 1/08*** | (2006.01) |

(52) U.S. Cl.

CPC ..... *B25B 23/1425* (2013.01); *B25B 13/463* (2013.01); *B25G 1/043* (2013.01); *B25G 1/085* (2013.01)

(58) Field of Classification Search

CPC . B25B 23/1425; B25B 23/147; B25B 13/463; B25G 1/043; B25G 1/085

USPC ..... 81/479; 73/862.21, 862.23

See application file for complete search history.

(56) References Cited

U.S. PATENT DOCUMENTS

| | | | | |
|---|---|---|---|---|
| 216,690 | A * | 6/1879 | Mikkelson | B25B 13/463 81/125.1 |
| 921,840 | A * | 5/1909 | Jacobs | B25G 1/105 279/93 |
| 2,725,086 | A * | 11/1955 | Keyes | B25B 23/16 16/426 |
| 3,970,155 | A * | 7/1976 | Otto | G01L 1/22 73/862.26 |
| 4,409,866 | A * | 10/1983 | McBride | B25G 1/04 16/429 |

(Continued)

OTHER PUBLICATIONS

U.S. Appl. No. 14/104,470, filed Dec. 12, 2013, Chih-Ching Hsieh.

*Primary Examiner* — Hadi Shakeri
(74) *Attorney, Agent, or Firm* — Guice Patents PLLC

(57) ABSTRACT

An electronic torque wrench includes: a shank body, a drive head being connected with a front end of the shank body; a handle having a front handle section and a rear handle section, the front handle section being connected with a rear end of the shank body, a cell room being formed in the front handle section for placing cells therein, a front end of the rear handle section being detachably connected with the rear end of the front handle section; an electronic operation/control device disposed on the shank body; and at least one torque sensor mounted on the shank body. The front and rear handle sections together form the handle for a user to hold. The rear handle section of the handle serves as a cell cap for closing the cell room so as to shorten the length of the wrench.

6 Claims, 7 Drawing Sheets

(56) References Cited

U.S. PATENT DOCUMENTS

| | | | | |
|---|---|---|---|---|
| 4,958,541 | A * | 9/1990 | Annis | B25B 23/1425 81/479 |
| 6,378,400 | B1 * | 4/2002 | Bogli | B25B 13/461 81/177.2 |
| 6,928,885 | B1 * | 8/2005 | Shiao | B25B 23/1425 73/862.191 |
| 6,968,759 | B2 * | 11/2005 | Becker | B25B 23/1425 73/862.23 |
| 7,415,897 | B2 * | 8/2008 | Shiao | B25B 23/1425 73/862.08 |
| 7,421,931 | B2 * | 9/2008 | Hu | B25B 13/461 81/177.4 |
| 7,478,566 | B2 * | 1/2009 | Liao | B25B 23/1425 73/862.21 |
| 8,091,438 | B1 * | 1/2012 | Huang | B25B 23/14 73/862.23 |
| 2002/0152820 | A1 * | 10/2002 | Tsuji | B25B 23/1425 73/862.21 |

* cited by examiner

ELECTRONIC TORQUE WRENCH WITH IMPROVED HANDLE

BACKGROUND OF THE INVENTION

1. Field of the Invention

The present invention relates generally to an electronic torque tool, and more particularly to an electronic torque wrench with improved handle.

2. Description of the Related Art

FIG. 1 is a side view of a conventional electronic torque wrench. The conventional electronic torque wrench includes a metal-made shank body 12, a drive head 14 mounted at one end of the shank body 12 for wrenching a threaded member, and a plastic-made housing 15 fitted on the shank body 12 with a rear end of the shank body 12 concealed in the housing 15. The electronic components of the torque wrench, such as the circuit board and the liquid crystal screen, are assembled in the housing. A rear half section of the housing 15 is integrally formed as a handle 16 for a user to hold. Several cells are mounted in the housing 15 to supply necessary power to the wrench. A plastic-made cell cap 18 is mounted at the rear end of the housing 15 to close the cell room in the housing.

According to the above arrangement, a user can hold the handle 16 to operate the conventional electronic torque wrench. The cell cap 18 is simply connected with the rear end of the housing 15 to close the cell room, not for holding. Moreover, the cell cap 18 itself is made of plastic material and unable to bear external force. Otherwise, the cell cap 18 will break and damage. According to such design, the cell cap 18 will lead to increase of the length and volume of the wrench. As a result, the space necessary for transfer and storage of the wrench is enlarged.

Besides, the handle 16 of the conventional electronic torque wrench is made of plastic material by molding. Therefore, the handle 16 has a fixed size without possibility of change. As a result, different users with different sizes of palms can hardly suitably use the conventional electronic torque wrench. Therefore, it has become a topic in this field how to selectively adjust the length of the handle 16 in adaptation to different users.

SUMMARY OF THE INVENTION

It is therefore a primary object of the present invention to provide an electronic torque wrench. A cell cap is mounted at a rear end of the wrench, and the object of the invention is that the cell cap is as a part of the handle of the wrench.

It is a further object of the present invention to provide the above electronic torque wrench in which the length of the handle is adjustable.

To achieve the above and other objects, the electronic torque wrench with improved handle of the present invention includes:

a shank body, a drive head being connected with a front end of the shank body;

a handle having a front handle section and a rear handle section, the front handle section being connected with a rear end of the shank body and integrally formed with the shank body, a rear end of the front handle section being inward recessed to form a cell room, a front end of the rear handle section being detachably connected with the rear end of the front handle section;

an electronic operation/control device disposed on the shank body;

at least one torque sensor mounted on the shank body for detecting the flexion extent of the shank body;

a front conductive member disposed in the cell room of the front handle section;

a rear conductive member disposed in the rear handle section; and at least one cell placed in the cell room of the front handle section in contact with the front and rear conductive members.

The front and rear handle sections of the handle have a holding length defined between a rear end of the electronic operation/control device and a rear end of the handle. The rear handle section has a length 0.25 time to 0.50 time the holding length.

In the above electronic torque wrench, the rear handle section is a part of the handle and serves as a cell cap for closing the cell room so as to shorten the length of the wrench and minify the volume of the wrench.

Preferably, the rear handle section is selected from a first rear handle section with a shorter length and a second rear handle section with a longer length, whereby the holding length of the handle can be changed.

Preferably, the electronic torque wrench further includes an extension handle section detachably connected with the rear end of the rear handle section so as to increase the length of the handle.

The present invention can be best understood through the following description and accompanying drawings, wherein:

DETAILED DESCRIPTION OF THE PREFERRED EMBODIMENTS

Figure 1:
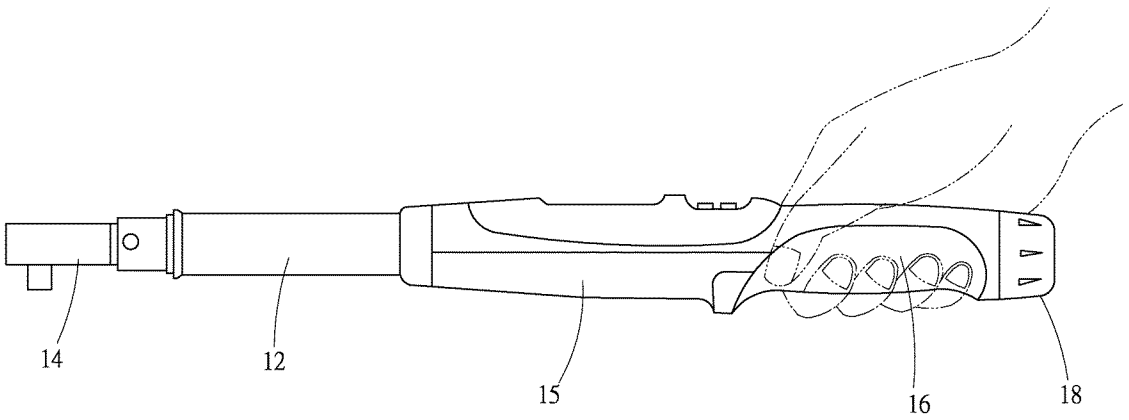
Fig. 1 PRIOR ART
FIG. 1 is a side view of a conventional electronic torque wrench.
Figure 2:
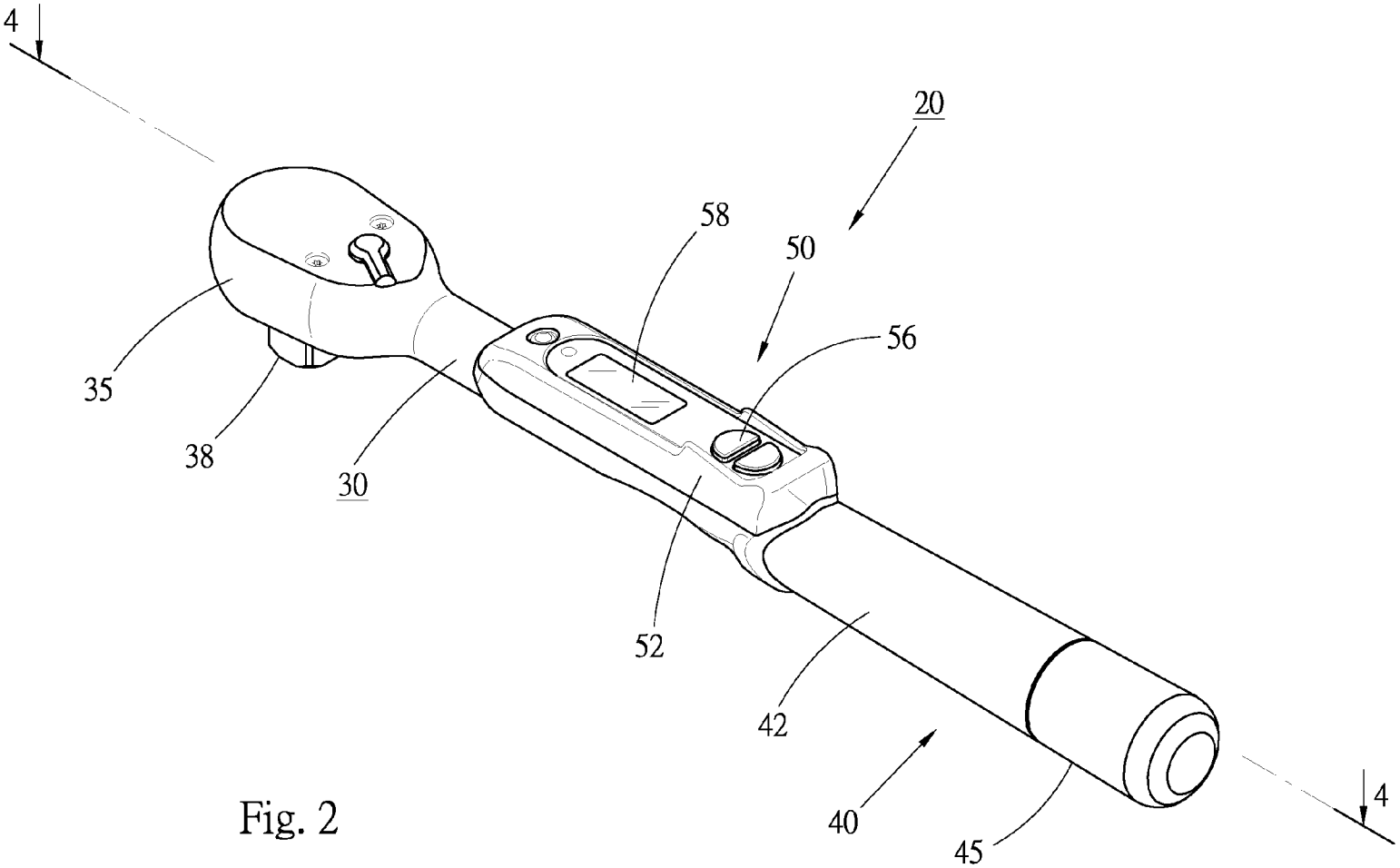
FIG. 2 is a perspective assembled view of a first embodiment of the present invention.
Figure 3:
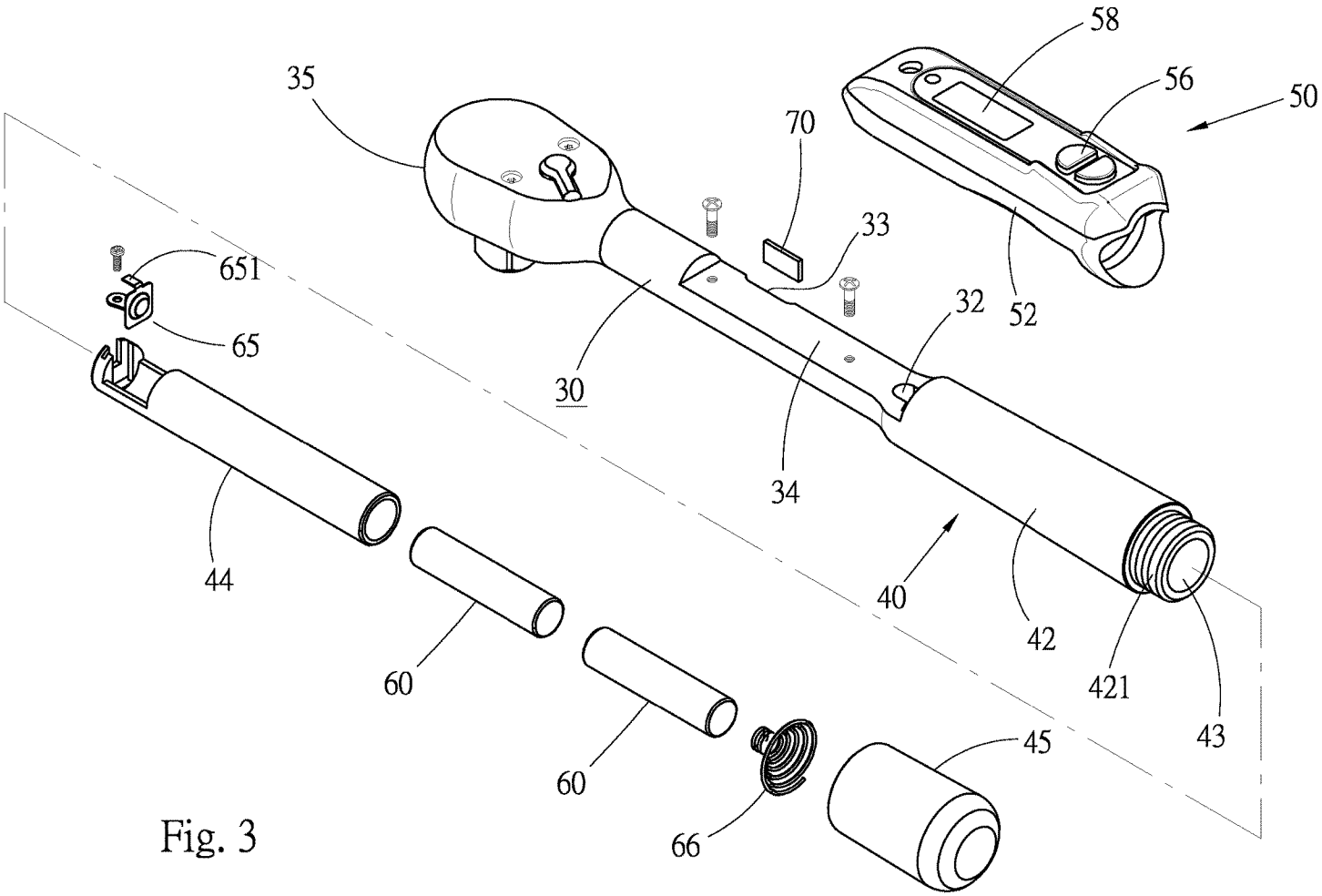
FIG. 3 is a perspective exploded view of the first embodiment of the present invention.

Please refer to FIGS. 2 and 3. According to a first embodiment, the electronic torque wrench 20 of the present invention includes a shank body 30, a drive head 35, a handle 40, an electronic operation/control device 50 and one or more cells 60 mounted in the handle 40.

The shank body 30 and the drive head 35 are made of metal material. The shank body 30 and the drive head 35 can be pivotally connected with each other or integrally formed and connected with each other. A drive assembly is disposed in the drive head 35 for wrenching a threaded member such as a nut or a bolt. Please refer to FIG. 4. The drive assembly generally is, but not limited to, a ratchet assembly having a ratchet 36. The ratchet 36 has a polygonal hole for fitting on a threaded member. Alternatively, the ratchet 36 is provided with an insertion post 38 for connecting with a socket.

Figure 4:
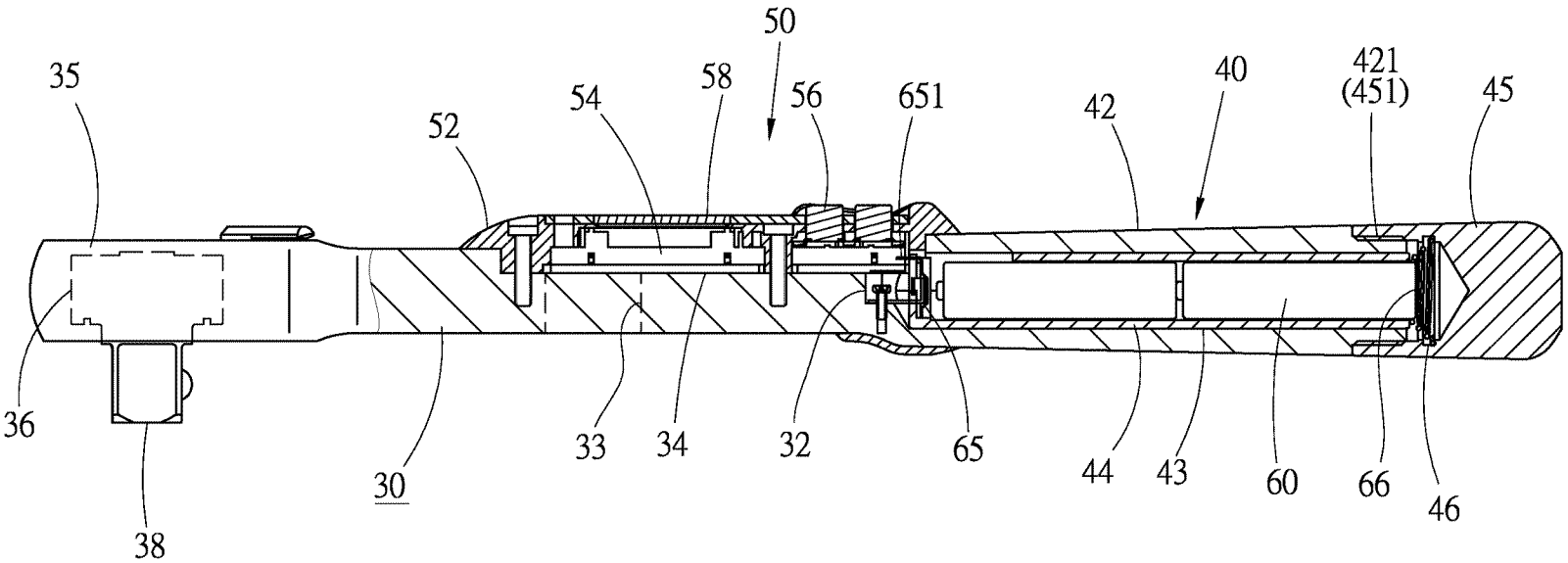
FIG. 4 is a sectional view taken along line 4-4 of FIG. 2.

Referring to FIG. 4, the handle 40 has a front handle section 42 and a rear handle section 45. The front handle section 42 is connected with a rear end of the shank body 30 and integrally formed with the shank body. A rear end of the front handle section 42 is inward recessed to form a cell room 43. A through hole 32 is formed at the rear end of the shank body 30 and extends through a front end of the front handle section 42 to communicate with the cell room 43. A plastic-made insulation sleeve 44 is mounted in the cell room 43.

The rear handle section 45 is also made of metal material. A front end of the rear handle section is inward recessed to form a socket 46. A front conductive member 65 is mounted in the cell room 43 of the front handle section 42. A rear conductive member 66 is mounted in the socket 46 of the rear handle section 45. The front conductive member 65 is inserted in a front end of the insulation sleeve 44 and positioned in an inner end of the cell room 43. The front end of the rear handle section 45 is formed with a thread 451 and the rear end of the front handle section 42 is formed with a thread 421. The threads 421, 451 are screwed with each other to detachably connect the front and rear handle sections 42, 45 with each other. However, the connection measure between the front and rear handle sections 42, 45 is not limited to screwing. After connected, the front and rear handle sections 42, 45 together form a complete handle 40 and the rear handle section 45 blocks the cell room 43. The adjacent sections of the two handle sections 42, 45 have conformable outer diameters so that the outer diameter of the handle 40 is not stepped at the adjacent sections of the two handle sections 42, 45. The handle as a whole has a cylindrical shape or a conic form shape. In the case that the handle 40 has a cylindrical shape, the two handle sections 42, 45 have equal outer diameters. Alternatively, as in this embodiment, the handle 40 as a whole has a conic shape. In this case, the outer diameter of the handle 40 is tapered from the rear handle section 45 to the front handle section 42. In this embodiment, the shank body 30 is a solid structure. The outer diameter of the handle 40 is larger than the outer diameter of the shank body 30, whereby a user can conveniently hold the handle 40.

At least one torque sensor 70 is disposed in a recess 33 formed on one side of the shank body 30. When the wrench is used to wrench a threaded member such as a nut or a bolt, the shank body 30 is a mainly flexed section of the wrench. The torque sensor 70 serves to detect the flexion of the shank body 30 to obtain the torque value of the wrench.

The electronic operation/control device 50 is mounted on the shank body 30 as an operation interface and display interface of the wrench 20. The operation/control device 50 has a housing 52 fitted on the shank body 30 to enclose the recess 33 and the torque sensor 70. The operation/control device 50 further has a circuit board 54, several pushbuttons 56 and at least one electronic display screen 58 disposed on the housing 52. The circuit board 54 is inbuilt with a microprocessor and several circuit units for executing the respective functions of the wrench, for example, torque detection circuit, power circuit, input/output circuit, display circuit, etc. The torque sensor 70, the pushbuttons 56 and the display screen 58 are all electrically connected to the circuit board 54. A top edge of the shank body 30 is depressed to form a platform 34. The operation/control device 50 is disposed on the platform 34 so that the volume of the operation/control device 50 that outward protrudes from the shank body 30 is minified. The recess 33 is formed in a position within the range of the platform 34.

Two cells 60 are placed in the insulation sleeve 44 of the cell room 43 of the front handle section 42 in contact with the two conductive members 65, 66. The first conductive member 65 has a conductive plate section 651 or a wire (not shown), which passes through the through hole 32 to electrically connect the first conductive member 65 to the electronic operation/control device 50, whereby the power of the cells 60 can be supplied to the electronic operation/control device 50. The pushbuttons 56 are power pushbutton and function pushbutton of the wrench for powering on/off the wrench and executing the use functions of the wrench. In use of the wrench, an operator holds the handle 40 and fits the drive head 35 of the wrench 20 onto a threaded member to wrench the same. The sensor 70 will detect the flexion extent of the shank body 30 to display the torque value on the display screen 58.

The electronic wrench of the present invention has a simplified structure. The handle 40 of the wrench 20 is composed of a front handle section 42 and a rear handle section 45. The rear handle section 45 is a part of the handle as a cell cap. The rear handle section 45 and the front handle section 42 are connected to form a complete handle. The front and rear handle sections are both made of metal material. Therefore, the handle is able to bear the force applied to the wrench by the user without possibility of breakage.

Figure 5:
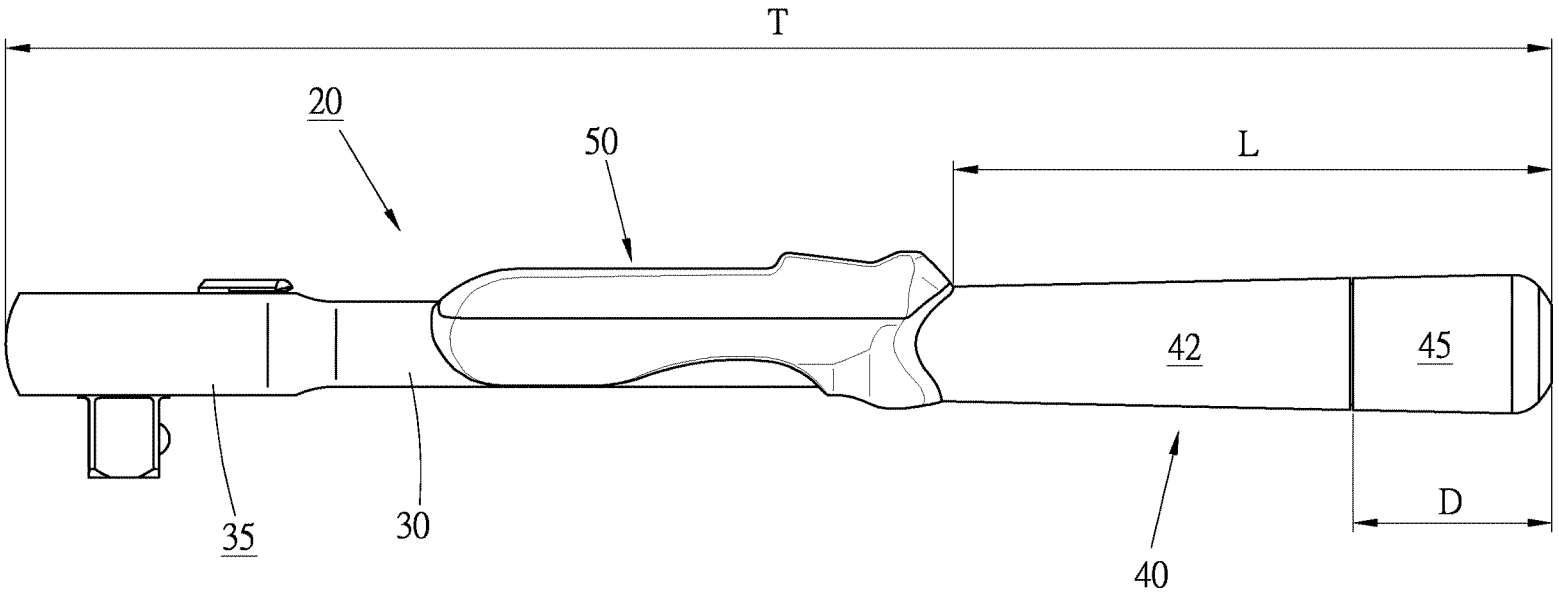
FIG. 5 is a side view of the first embodiment of the present invention.

The handle of the present invention has a specific ratio relationship. Please refer to FIG. 5. The handle 40 has a holding length L formed between the rear end of the electronic operation/control device and the rear end of the handle. The rear handle section 45 has a length D 0.25 to 0.5 time the holding length L, and preferably 0.28 to 0.46 time the holding length L. The holding length L is 0.33 to 0.45 time the total length T of the wrench, and preferably 0.35 to 0.43 time the total length T.

In the first embodiment, the length D of the rear handle section 45 is 0.30 to 0.38 time the holding length L, and especially preferably 0.32 to 0.36 time the holding length L. The following table shows the sizes of three models of wrenches as the examples of the present invention:

| | holding length L | length of rear handle section D | length of handle T |
|---|---|---|---|
| model A wrench | 109 mm | 37 mm | 281 mm |
| model B wrench | 93 mm | 33 mm | 222 mm |
| model C wrench | 82 mm | 29 mm | 211 mm |

The holding length L of the wrench of the present invention falls within the range from 70 mm to 130 mm. When any user holds the handle 40, the user will hold the front and rear handle sections 42, 45 at the same time. Accordingly, the rear handle section 45 serves as a part of the handle 40 in use. The length T of the wrench ranges from 210 mm to 310 mm.

Figure 6:
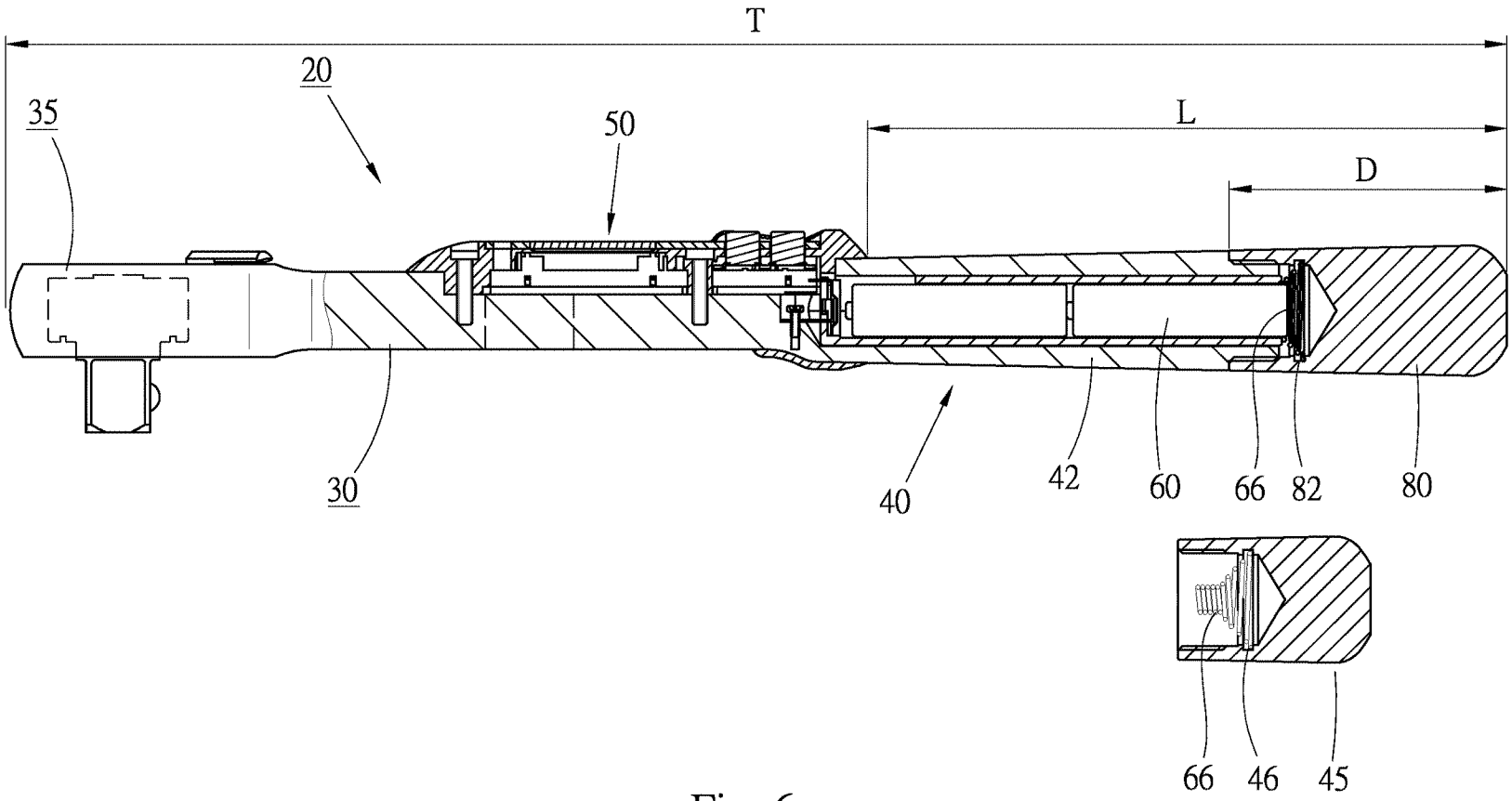
FIG. 6 is a longitudinal sectional view of a second embodiment of the present invention.

FIG. 6 shows a second embodiment of the wrench 20 of the present invention, in which the same components are denoted with the same reference numerals and will not repeatedly described hereinafter. The second embodiment is different from the first embodiment in that the wrench 20 includes the above rear handle section 45 as a first rear handle section and further includes a second rear handle section 80 with a longer length. A second rear conductive member 66 is mounted in the cavity 82 of the rear handle section 80. The rear handle section 80 is also detachably connected with the front handle section 42 by means of screwing or other equivalent measure.

In this embodiment, two different lengths of rear handle sections are provided, whereby a user can selectively assemble the shorter rear handle section 45 or the longer second rear handle section 80 with the front handle section 42 to change the use length of the handle 40. With model A wrench taken as an example, when assembling the second rear handle section 80 with the front handle section, the holding length L is 129 mm, the length D of the rear handle section 80 is 57 mm, while the length T of the wrench is 301 mm.

When the longer second rear handle section 80 is assembled with the front handle section, the length D of the second rear handle section is 0.36 time to 0.50 time the holding length L, and preferably 0.42 time to 0.46 time the holding length L, while the holding length L is 0.40 time to 0.45 time the length T of the wrench. When the shorter first rear handle section 45 is assembled with the front handle section, the length D of the rear handle section is 0.25 time to 0.38 time the holding length L, and preferably 0.30 time to 0.36 time the holding length L, while the holding length L is 0.33 time to 0.40 time the length T of the wrench.

Figure 7:
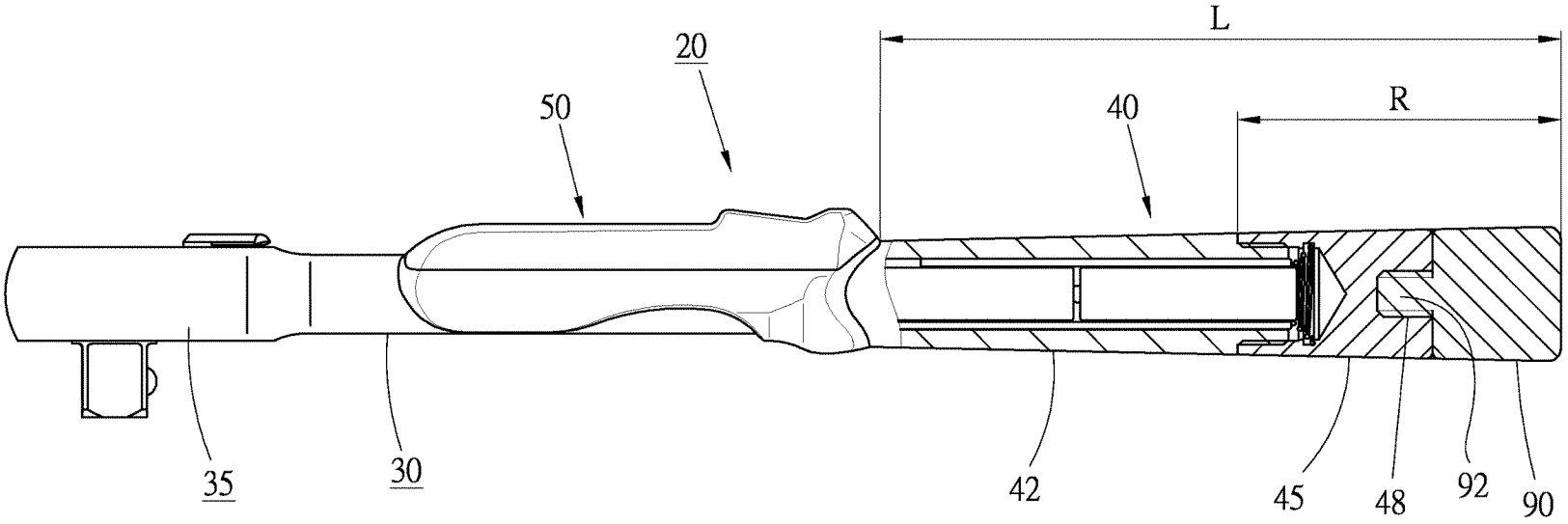
FIG. 7 is a side partially sectional view of a third embodiment of the present invention.

FIG. 7 shows a third embodiment of the wrench 20 of the present invention, in which the same components are denoted with the same reference numerals and will not repeatedly described hereinafter. In the third embodiment, the rear end face of the rear handle section 45 is formed with a threaded hole 48. The wrench further includes at least one extension handle section 90, which is a cylindrical body or a conic body. The outer diameter of the extension handle section 90 corresponds to the outer diameter of the rear handle section 45 of the handle 40. A threaded rod 92 is disposed on a front end face of the extension handle section 90. The threaded rod 92 can be screwed into the threaded hole 48 to detachably connect the extension handle section 90 with the rear end of the rear handle section 45. Accordingly, the extension handle section 90 can be assembled with the rear end of the rear handle section 45 to increase the length of the handle 40. The handle 40 has a holding length L between the rear end of the electronic operation/control device 50 and the rear end of the extension handle section 90 of the handle. A user with a larger palm can be easily hold the handle 40. The rear handle section 45 and the extension handle section 90 together have a rear section length R on the rear half of the handle 40. The rear section length R is 0.44 time to 0.67 time the holding length L. A user with a smaller palm can selectively remove the extension handle section 90.

In the electronic torque wrench of the present invention, the rear handle section of the handle serves as a cell cap. In this case, the length and volume of the wrench can be effectively minified to save the transfer and storage space of the wrench. Moreover, the wrench can be conveniently used in a narrow space.

Furthermore, in the second and third embodiments of the present invention, the length of the handle is changeable, whereby different users can adjust the length of the handle according to the size of the users' palms. Under such circumstance, it is no more difficult for a manufacturer to determine how long the length of the wrench should be.

The above embodiments are only used to illustrate the present invention, not intended to limit the scope thereof. Many modifications of the above embodiments can be made without departing from the spirit of the present invention.

What is claimed is:

1. An electronic torque wrench with improved handle, comprising:

a shank body, a drive head being connected with a front end of the shank body;

a handle having a front handle section and a rear handle section, the rear handle section being selected from a first rear handle section with a shorter length and a second rear handle section with a longer length, the length of the second rear handle section being longer than the length of the first rear handle section, the front handle section being connected with a rear end of the shank body and integrally formed with the shank body, a rear end of the front handle section being inward recessed to form a cell room, a front end of the rear handle section being detachably connected with the rear end of the front handle section;

an electronic operation/control device disposed on the shank body;

at least one torque sensor mounted on the shank body;

a front conductive member disposed in the cell room of the front handle section;

a rear conductive member disposed in the rear handle section;

at least one cell placed in the cell room of the front handle section in contact with the front and rear conductive members; and the front and rear handle sections of the handle having a holding length formed between a rear end of the electronic operation/control device and a rear end of the handle; when the first rear handle section is selected as the rear handle section, the length of the rear handle section being 0.25 times to 0.38 times the holding length;

when the second rear handle section is selected as the rear handle section, the length of the rear handle section being 0.36 times to 0.50 times the holding length.

2. The electronic torque wrench as claimed in claim 1, wherein the holding length of the handle ranges from 70 mm to 130 mm and the length of the wrench ranges from 210 mm to 310 mm, the holding length being 0.33 times to 0.45 times the length of the wrench.

3. The electronic torque wrench as claimed in claim 1, wherein a top edge of the shank body is depressed to form a platform, the operation/control device being disposed on the platform, at least one recess being formed on one side of the shank body, the recess being formed in a position within the range of the platform, the torque sensor being disposed in the recess.

4. The electronic torque wrench as claimed in claim 1, wherein the front end of the rear handle section is formed with a socket and the rear conductive member is disposed in the socket.

5. The electronic torque wrench as claimed in claim 1, wherein the front handle section and the rear handle section are both made of metal material and the front handle section has an outer diameter conforming to an outer diameter of the rear handle section.

6. The electronic torque wrench as claimed in claim 1, further comprising an extension handle section, the extension handle section being detachably connected with the rear end of the rear handle section, the extension handle section having an outer diameter conforming to an outer diameter of the rear handle section.

* * * * *